US006354412B1

(12) United States Patent
Kuo

(10) Patent No.: US 6,354,412 B1
(45) Date of Patent: Mar. 12, 2002

(54) WHEEL BRACKET FOR WHEELED LUGGAGE

(75) Inventor: Chung-Hsie Kuo, Pan-Chiao (TW)

(73) Assignee: Chaw Khong Technology Co., Ltd., Taipei County (TW)

( * ) Notice: Subject to any disclaimer, the term of this patent is extended or adjusted under 35 U.S.C. 154(b) by 0 days.

(21) Appl. No.: 09/390,671

(22) Filed: Sep. 7, 1999

(30) Foreign Application Priority Data

Jun. 4, 1999 (TW) ..... 88209173 U

(51) Int. Cl.[7] ..... A45C 13/00; A45C 5/00; B60B 23/00; B60B 27/02

(52) U.S. Cl. ..... 190/18 A; 301/111

(58) Field of Search ..... 301/111, 114, 301/121, 125; 190/18 AI

(56) References Cited

U.S. PATENT DOCUMENTS 5,456,342 A * 10/1995 Rekuc et al. ..... 190/18 A
5,498,010 A * 3/1996 Stube ..... 190/18 A
5,590,748 A * 1/1997 Chang ..... 190/18 A
5,634,538 A * 6/1997 Tsai ..... 190/18 A
5,875,876 A * 3/1999 Wang ..... 190/18 A
5,918,710 A * 7/1999 Sher ..... 190/18 A
6,024,194 A * 2/2000 Chung-Hsien ..... 190/18 A
6,113,196 A * 9/2000 Kuo ..... 190/18 A

* cited by examiner

*Primary Examiner*—S. Joseph Morano
*Assistant Examiner*—Jason R. Bellinger
(74) *Attorney, Agent, or Firm*—Dougherty & Troxell

(57) ABSTRACT

A wheel bracket for wheeled luggage comprises a convex top portion of the wheel housing situated above the bottom plate; a raised portion formed from a higher portion to a lower portion on a surface of the front plate; and a first plurality of recesses and a plurality of longitudinal and transverse ribs formed on a back of the front plate in which one of the first recesses having a lowest height is substantially flush with a highest point of the convex top portion; wherein a second recess is formed on a bottom of the raised portion having a height generally equal to that of the convex top portion, and the second recess substantially has the same thickness in longitudinal cross-section as remaining portions of the front plate. With this construction, the raised portion of the wheel bracket substantially has the same thickness in its longitudinal cross-section. Further, the wheel bracket may be manufactured in a single injection molding with a smooth surface of the front plate.

3 Claims, 7 Drawing Sheets

WHEEL BRACKET FOR WHEELED LUGGAGE

BACKGROUND OF THE INVENTION

1. Field of the Invention

The present invention relates to wheel bracket for wheeled luggage in which a the front portion of the wheel bracket substantially has the same thickness in its longitudinal cross-section.

2. Description of Prior Art

A conventional wheeled luggage is shown in FIGS. 1A–1D in which a circumferential frame member T is a principal structural component of body A; a wheel bracket B is disposed in each bottom corner of the body A; and an arcuate-shaped portion C of the wheel bracket B is formed between a side plate S and a bottom plate M for permitting the frame member T to pass through the interface between the arcuate-shaped portion C and front plate F. Further, a raised portion F4 is formed from the higher portion to the lower portion on the front plate F of bracket B for enhancing strength and preventing the body A from being damaged by a collision with an external object. Accordingly, a number of recesses F1, a number of longitudinal and transverse ribs F2, and a hole F3 are formed on the back of front plate F for achieving a smooth surface of the front plate F by means of injection molding. That is, the front plate F substantially has the same thickness in its longitudinal cross-section. However, wheel housing H is disposed below the bottom plate M of bracket B, i.e., the bracket B is external to the body A. As such, the length from the top of body A to the bottom of wheel W is longer than the height of the upright luggage. In other words, the effective capacity of the luggage is decreased. Further, a luggage stored in the cargo area of an aircraft is no more than 22"(height)×14"(width)×9" (length) as governed by the Warsaw Convention. As such, wheels can be completely or partially retracted into the luggage is desirable for obtaining a maximum case capacity. This is a design as described below.

Another conventional wheeled luggage for overcoming the above deficiency is shown in FIGS. 2A–2C. Similarly, a number of recesses F1, a number of longitudinal and transverse ribs F2, and a hole F3 are formed on the back of front plate F. It is seen that a substantial portion of the wheel W is retracted into the luggage. Further, the center of wheel W is elevated to just above the bottom of luggage case. As such, the raised portion F4 of front plate F is further protruded and the height of wheel housing H is elevated above the arcuate-shaped portion C and the bottom plate M. However, it is disadvantageous to intercept the frame member T by intersection region of the bottom plate M, the front plate F, and the side plate S. As a result, the strength of the frame member T is decreased, and further, the assembly time of the luggage components is adversely prolonged.

Thus, it is desirable to provide an improved wheel bracket for wheeled luggage to overcome the above drawbacks of prior art.

SUMMARY OF THE INVENTION

It is an object of the present invention to provide a wheel bracket for wheeled luggage in which a substantial portion of the wheel is retracted into the luggage body without intercepting the frame member so as to maintain a desirable supporting strength.

It is another object of the present invention to provide a wheel bracket for wheeled luggage in which an aesthetic recess is formed on the front portion of the wheel bracket which can be manufactured in a single injection molding, thereby improving yield.

It is still another object of the present invention to provide a wheel bracket for wheeled luggage in which the front portion of the wheel bracket substantially having the same thickness in its longitudinal cross-section. Further, the back of wheel bracket may be manufactured by the injection molding for reducing cost and facilitating assembly.

The advantages of the present invention are realized by providing a wheel bracket for wheeled luggage having a front plate, a bottom plate, a side plate perpendicular to one another and forming an arcuate-shaped portion therebetween, and a wheel housing shaped to receive a wheel, the improvement comprising a convex top portion of the wheel housing situated above the bottom plate; a raised portion formed from a higher portion to a lower portion on a surface of the front plate; and a first plurality of recesses and a plurality of longitudinal and transverse rib members formed on a back of the front plate in which one of the first recesses having a lowest-height is substantially flush with a highest point of the convex top portion; wherein said raised portion on the surface of the front plate comprises a second recess having a height generally equal to that of the convex top portion, and said second recess substantially has the same thickness in longitudinal cross-section as remaining portions of the front plate.

The above and other objects, features and advantages of the present invention will become apparent from the following detailed description taken with the accompanying drawings.

DETAILED DESCRIPTION OF PREFERRED EMBODIMENTS

Figure 1A:
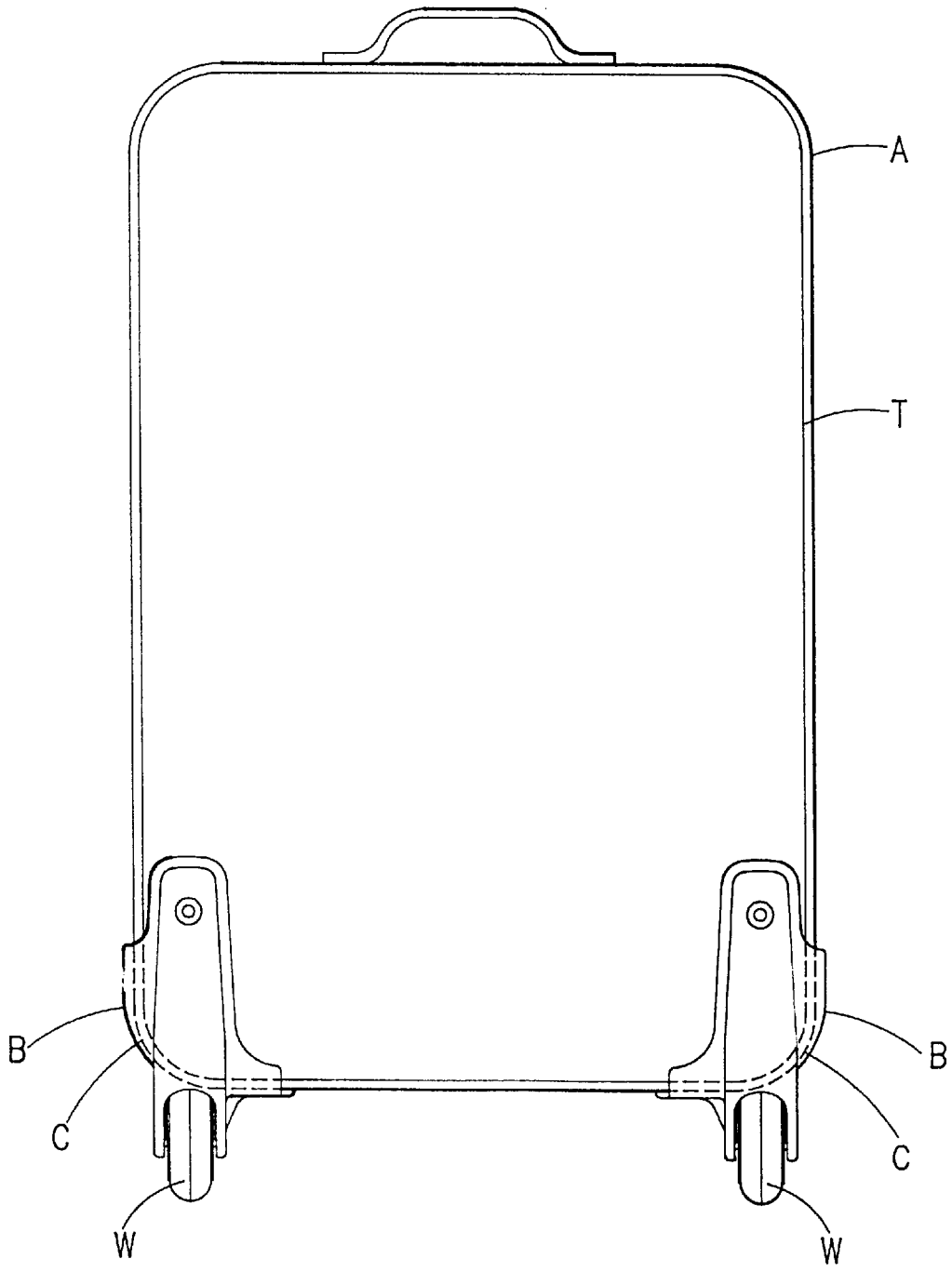
FIG. 1A (PRIOR ART)
FIG. 1A is a frost view showing disposition of the frame member and the wheels of a prior art wheel bracket for wheeled luggage.
Figure 1B:
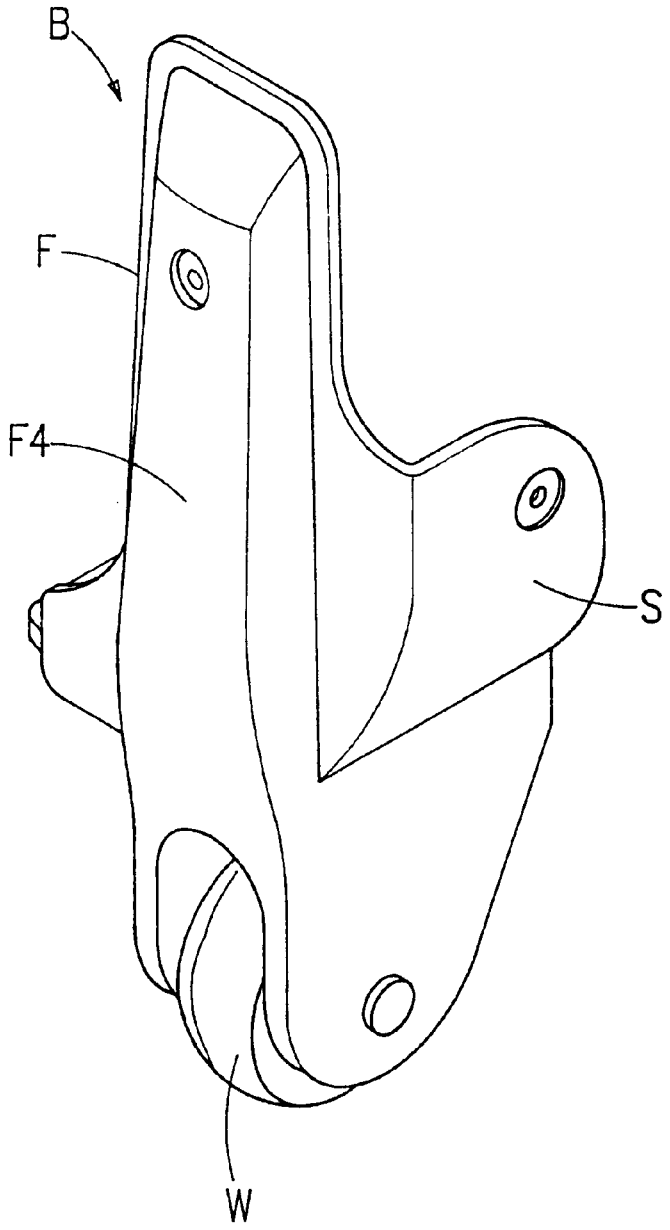
FIG. 1B (PRIOR ART)
FIGS. 1B–1D are perspective, front, and back views of wheel bracket for wheeled luggage of FIG. 1A respectively.
Figure 1C:
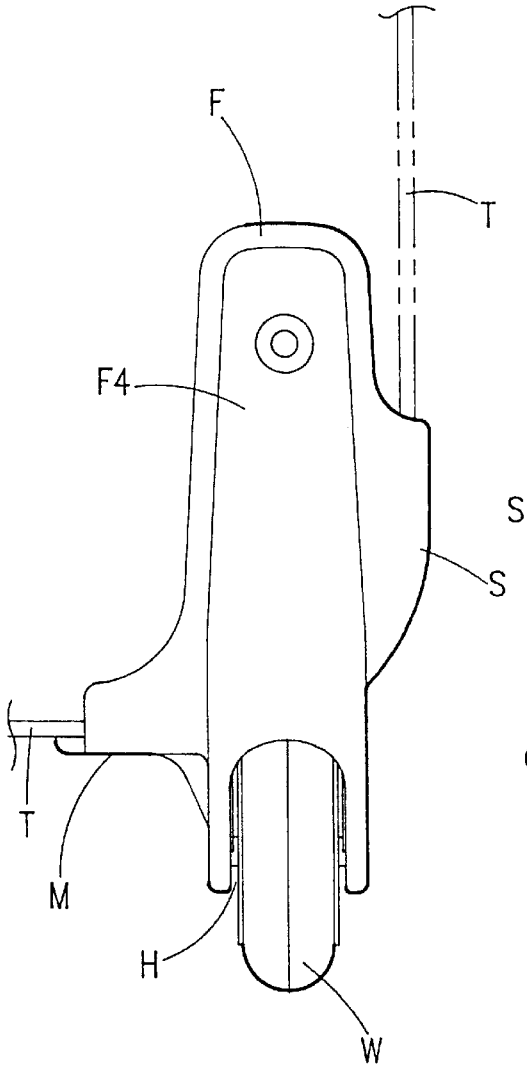
FIG. 1C (PRIOR ART)
Figure 1D:
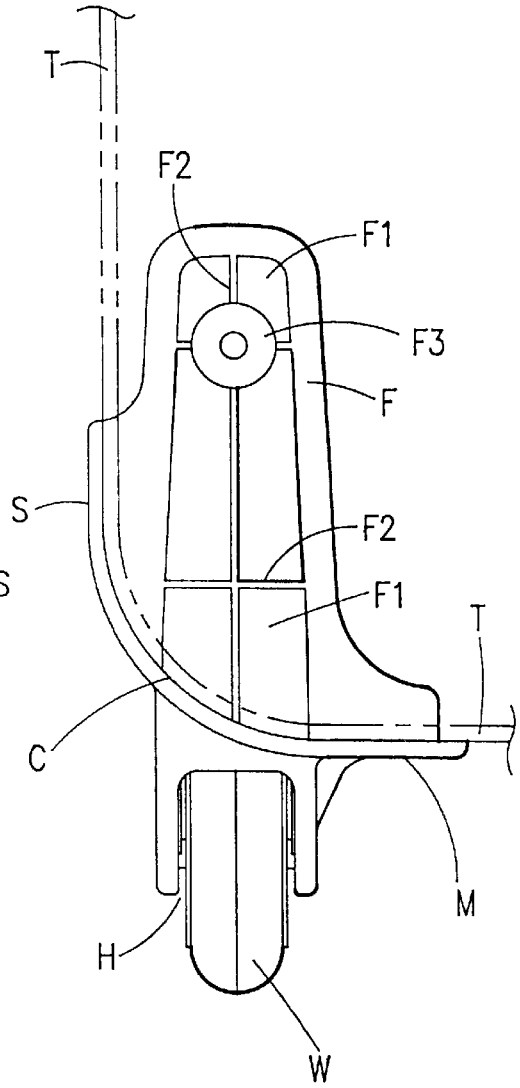
FIG. 1D (PRIOR ART)
Figure 2B:
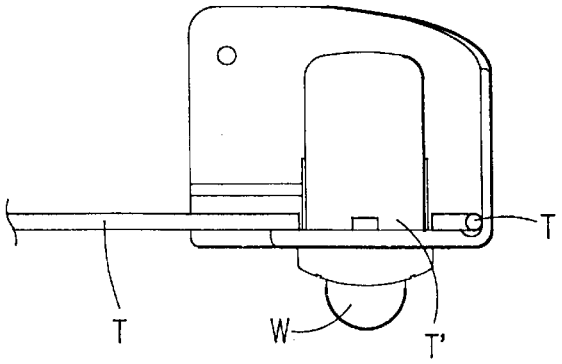
FIG. 2B (PRIOR ART)
FIGS. 2A–2C are back, top, and front views of another prior art wheel bracket for wheeled luggage.
Figure 2A:
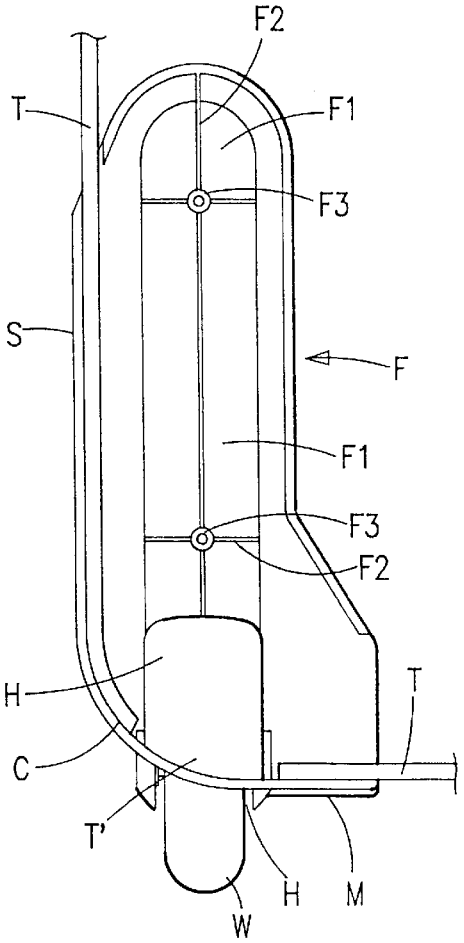
FIG. 2A (PRIOR ART)
Figure 2C:
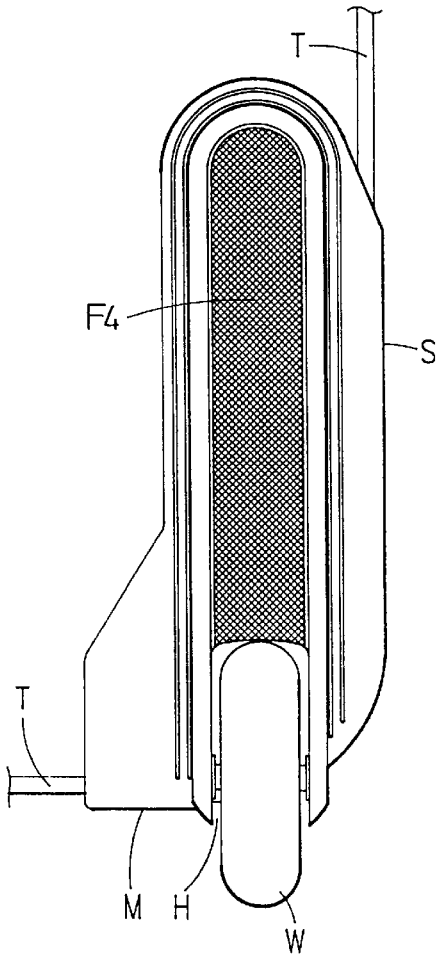
FIG. 2C (PRIOR ART)

Referring to FIG. 3A–3D, there is shown a wheel bracket for wheeled luggage comprising a wheel bracket 10 having a front plate 11 parallel to the front of luggage, a bottom plate 12 parallel to the bottom of luggage, a side plate 13 parallel to the side of luggage, and a wheel housing 14 shaped to provide a recess around a wheel 15, i.e., a substantial portion of the wheel 15 is retracted into the luggage body for obtaining a maximum case capacity. The front, bottom, and side plates 11, 12, and 13 are perpendicular to one another in which a substantially arcuate-shaped portion L is formed in the intersection region of these three plates. A convex top portion 141 of the wheel housing 14 is situated above the bottom plate 12. A raised portion 111 is formed from the higher portion to the lower portion on the surface of front plate 11. A number of recesses 112 and longitudinal and transverse ribs 113 are formed on the back of front plate 11. A pair of holes 114, each formed on the intersection of a longitudinal rib 113 and a transverse rib 113, may be threaded through by a screw or fastener known in the art. The bottom of a lowest recess 112 is substantially flush with the highest point of convex top portion 141. One of the novel features of the invention is that an aesthetic "drop of water"-shaped recess 115 is formed on the bottom of raised portion 111 having a height generally equal to that of convex top portion 141, and said recess 115 substantially has the same thickness in longitudinal cross-section as the remaining portions of front plate 11 as specifically illustrated in FIG. 3C. As such, the front plate 11 may be manufactured in a single injection molding, hereby improving yield.

Figure 3A:
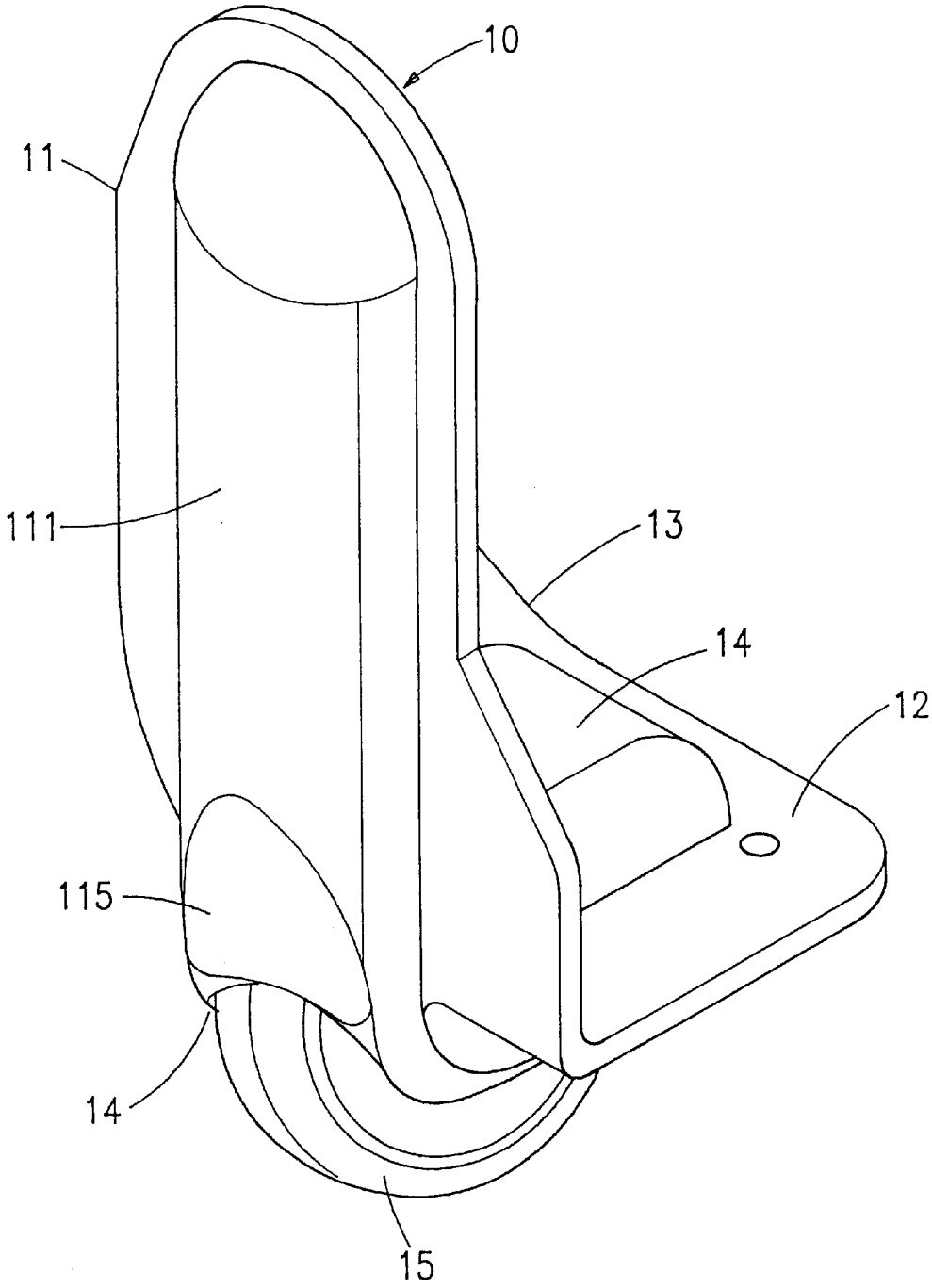
FIGS. 3A–3D are perspective, back, side-cross sectional and top views of a preferred embodiment of the present invention.
Figure 3B:
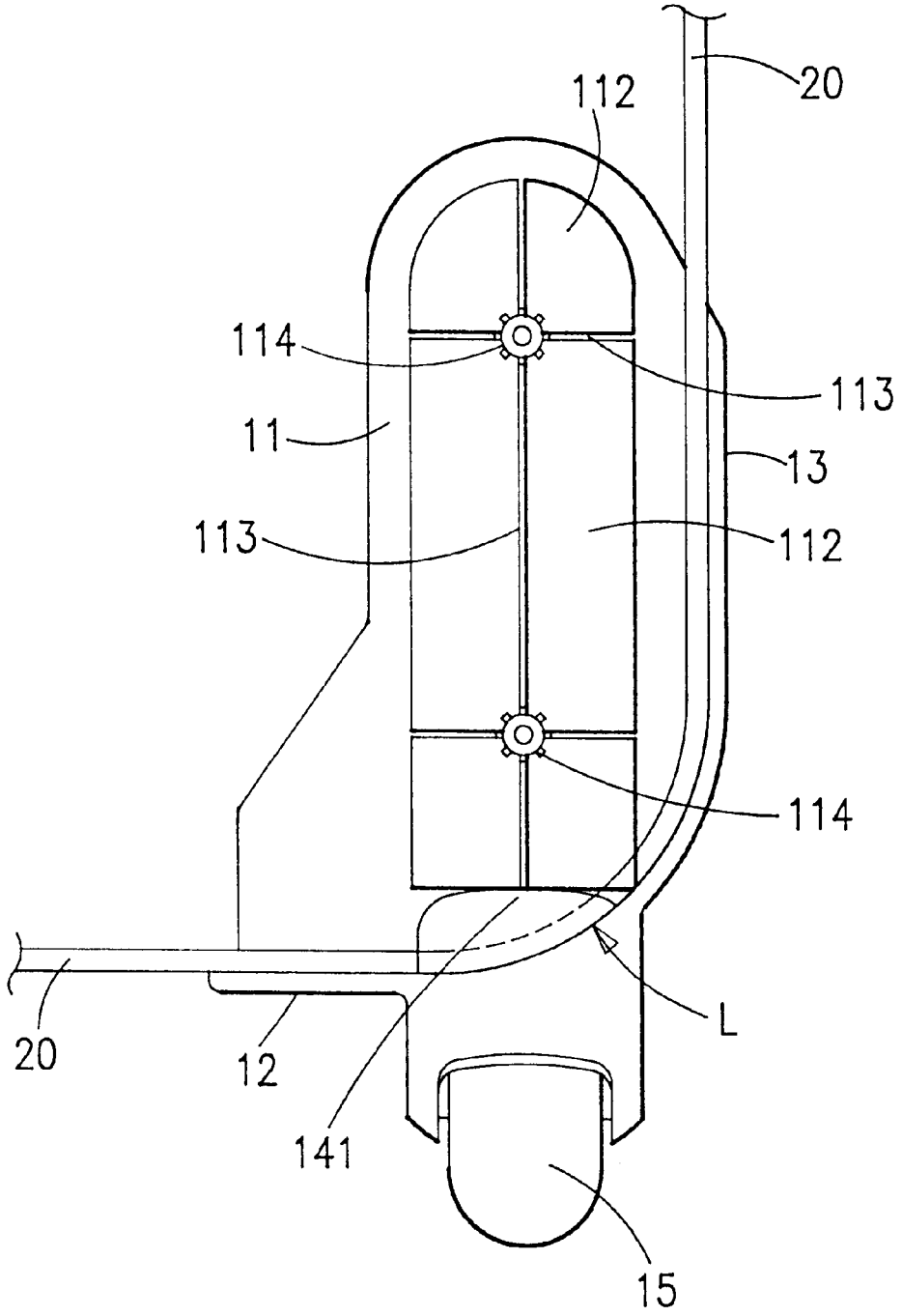
Figure 3D:
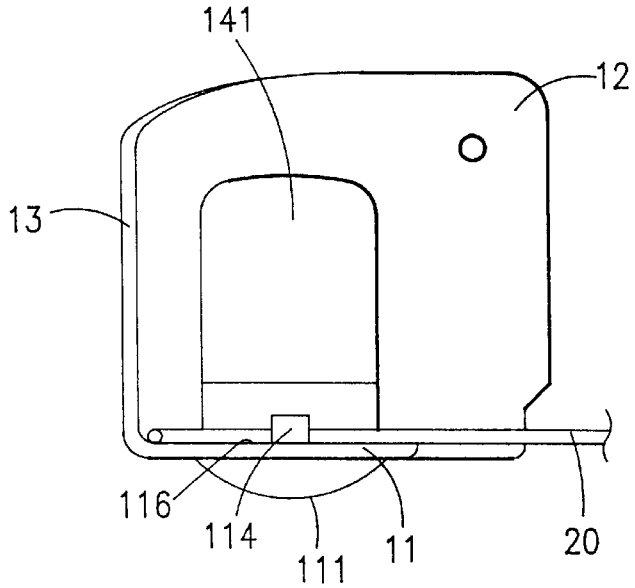
Figure 3C:
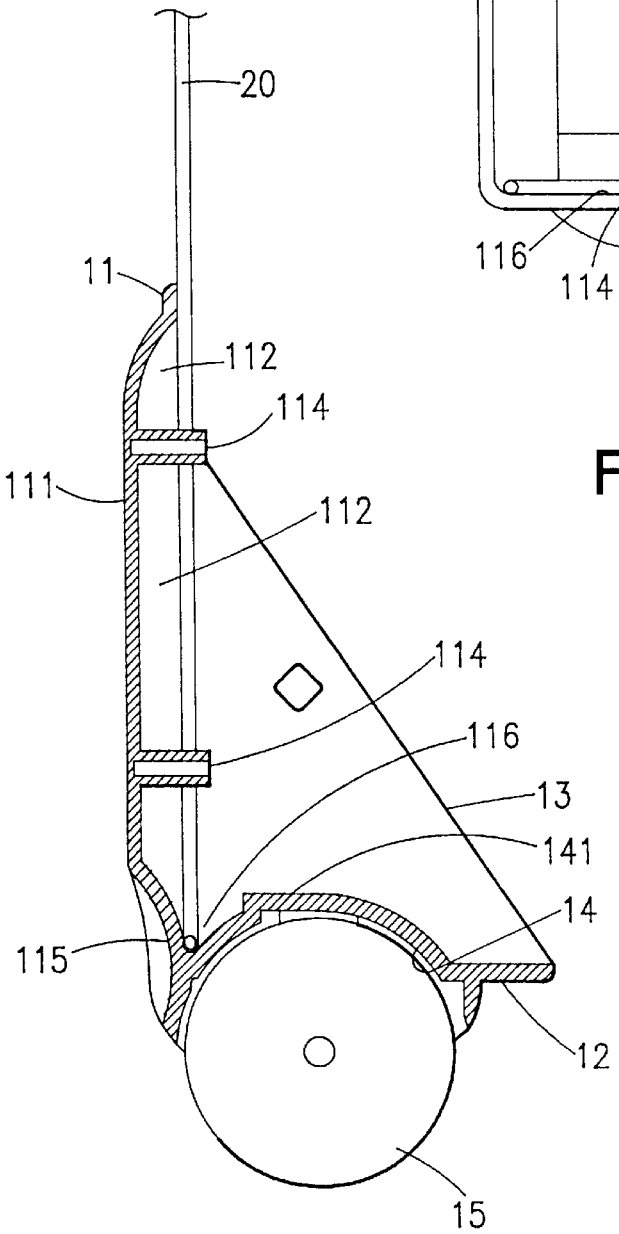

Referring to FIGS. 3C–3D specifically, a trough 116 is formed between the front plate 11 and the wheel housing 14 for permitting frame member 20 to pass through. As a result, the frame member 20 is without being intercepted which facilitates the assembly of luggage as well as maintains a desirable supporting strength to the luggage.

While the invention herein disclosed has been described by means of specific embodiments, numerous modifications and variations could be made thereto by those skilled in the art without departing from the scope of the invention set forth in the claims.

What is claimed is:

1. A wheel bracket for wheeled luggage having a longitudinally extending front plate, a bottom plate, a side plate perpendicular to one another and forming an arcuate-shaped portion in said front and bottom plates, and a wheel housing shaped to receive a wheel, the improvement comprising:

a convex top portion of the wheel housing situated above the bottom plate;

said longitudinally extending front plate including a hither portion and a lower portion, a front and a back;

a raised portion extending from said higher portion to said lower portion on said front of the front plate; and, a first plurality of recesses and a plurality of longitudinal and transverse rib members formed on said back of the front plate in which one of the first plurality of recesses abutting a highest point of the convex top portion;

wherein said raised portion on said front of the front plate includes a second concave recess having a depth generally equal to that of the convex top portion, and said second recess having approximately the same depth in longitudinal cross section as the height of said raised portion of the front plate.

2. The wheel bracket of claim 1, further comprising a trough formed between the front plate and the wheel housing for permitting a frame member to pass through.

3. The wheel bracket of claim 1 wherein the second recess has a shape in the form of an upper portion of a tear drop with a generally concave lower portion.

* * * * *